United States Patent [19]

Maynard, Jr.

[11] Patent Number: 4,969,698

[45] Date of Patent: Nov. 13, 1990

[54] PORTABLE DESK

[76] Inventor: Stuart T. Maynard, Jr., 12 Lookout Rd., Asheville, N.C. 28805

[21] Appl. No.: 264,838

[22] Filed: Oct. 31, 1988

[51] Int. Cl.[5] ..... A47F 3/04

[52] U.S. Cl. ..... 312/237; 312/233; 312/231; 312/348; 312/255

[58] Field of Search ..... 312/195, 194, 255, 348, 312/286, 231, 233, 237; 108/12, 27, 132; 211/69.1; 248/449, 439, 453

[56] References Cited

U.S. PATENT DOCUMENTS

| | | | |
|---|---|---|---|
| 183,536 | 10/1876 | Christie | 312/255 X |
| 449,482 | 3/1891 | Levy | 312/348 X |
| 791,112 | 5/1905 | Rothwell | 312/286 |
| 1,138,156 | 5/1915 | Stroud . | |
| 1,314,060 | 8/1919 | Hagerstrom | 108/27 |
| 1,483,421 | 2/1924 | Farnham | 248/453 |
| 1,579,678 | 4/1926 | Wade | 312/233 |
| 2,550,279 | 4/1951 | Mamer | 248/453 |
| 3,147,052 | 9/1964 | Carr et al. | 312/241 |
| 3,147,949 | 9/1964 | Webster | 248/463 |
| 3,273,846 | 9/1966 | DeMare | 211/69.1 X |
| 3,652,051 | 3/1972 | McFarlane | 248/463 |
| 3,695,567 | 10/1972 | Weagle | 108/132 X |
| 3,701,576 | 10/1972 | Moen | 312/231 |
| 3,730,077 | 5/1973 | Boynton | 108/43 |
| 3,821,936 | 7/1974 | Moorse | 108/43 |
| 4,052,944 | 10/1977 | Jennings | 108/43 |
| 4,106,413 | 8/1978 | Hoaglund | 248/439 X |

OTHER PUBLICATIONS

Fixed Frame Lap Desk Sketch (1 sheet) undated.

*Primary Examiner*—Joseph Falk

[57] ABSTRACT

A portable desk having a work surface panel is supported over a seated user by support compartments which extend to the seat surface during use. The support compartment folds to the underside of the work surface panel when not in use so that the desk can be freestanding on the work surface panel front edge. The support compartments provide storage for books and a pencil holder. A drawer beneath the work surface panel is slideable in two directions, toward the user for access and away from the user to support books or papers proximate the work surface panel and is sandwiched between the work surface panel and the storage compartments when the storage compartment are folded under the work surface panel.

13 Claims, 7 Drawing Sheets

PORTABLE DESK

FIELD OF THE INVENTION

This invention relates to providing support of reading and writing materials for a person seated on a couch, chair, bench, or bedside to a position above the user's lap inclined away from the user.

BACKGROUND AND DESCRIPTION OF THE PRIOR ART

Support of materials above the user's lap provides freedom of movement for the lower body compared to lap boards which must be placed upon the lap. Support of the user's arms, as well as materials and the hands, gives added relief to shoulder muscular tension. Elevation also brings materials to an appropriate visual range thus decreasing downward flexion of the neck. U.S. Pat. No. 3,147,949 discloses a lapboard that is somewhat elevated and inclined rather greatly while being supported on the lap. U.S. Pat. No. 3,730,077 discloses a collapsible lapboard that elevates a clipboard above the user's lap, taking on some of the character of a desk surface.

If a portable desk is not being used, folding features are convenient and previous disclosures have included folding of supports against a top panel such as seen in U.S. Pat. No. 1,138,156 for a folding invalid tray.

Without storage in the desk, a user must bring all items to the location of use and also must remove the desk for obtaining additional items. Using storage within a table is disclosed in U.S. Pat. No. 3,147,052, which is a combination storage case and table. However, this design requires that all stored items be removed to set up and use the table. A lap supported work tray, U.S. Pat. No. 3,701,576 discloses a tray top which slides over a "drawer" which is in turn supported on the user's lap.

OBJECTS OF THE INVENTION

It is therefore an object of this invention to provide a foldable desk that supports reading, writing, or other materials above the lap at a visual distance offering comfort to the neck and back of the user.

It is another object of the invention to support the arms of the user as well as materials or the user's hands while holding materials.

It is yet another object of the invention to provide storage features in a foldable desk for containing items such as pencils, books, writing pads, and paper in various parts of the desk during use and storage of the desk.

It is also another object of the invention to provide a folding desk which is freestanding in the folded configuration for storage, such as between or behind furniture, and which is easily grasped and handled while folded.

It is also an object to provide a portable desk which is convenient for use of a standing person when placed on an ordinary table top.

SUMMARY OF THE INVENTION

In accordance with one form of this invention, there is provided a planar board-like work surface panel which is sustained on a pair of support compartments that extend to the seat surface of a sofa such as on each side of a seated individual. The support compartments are defined by a quadrangle of members including a base member which rests and can skid upon the sofa seat surface from which two upright members join an upper, hingeable member at right angles. Depending on the angle of intersection of the base member joining the upright member, the desk (work surface panel, drawer, and hingeable member) is inclined away from the user with the work surface panel ascending greater, as measured further from the user.

The support compartments which have broad exterior members define a storage space to which barriers such as dowel-like vertical side rails are added to retain books or pads parallel to the plane of the quadrangle such that the stored items therein cannot pass between the barriers unless the same is intentionally rotated to slide past the dowel-like barrier rails.

A specialized compartment for pencil storage is contained within one portion of the support compartment. This pencil holder is achieved by a cylindrical tube (long enough for most pencils) held between the hingeable and base members of the storage quadrangle. During use, the cylinder is vertically positioned and the bottom of the cylinder is sealed by the base member and a passage hole for pencils is provided in the hingeable member which overlays the top of the cylinder. When the desk is stored and in normal freestanding position, the cylinder is horizontal with the passage hole appropriately aligned to the uppermost aspect of the cylinder wall. Pencils or pens may be manipulated out of the tube by fingers reaching through a pair of openings in the side walls of the cylinder. A pen may be passed out of the cylinder through the passage hole in the hingeable member and the passage hole is aligned or offset with one side wall of the cylinder so that the pen can slide easily against the cylinder wall and through the passage hole. The pencil holder may also be affixed directly underneath the work surface panel with an aperture in the work surface panel for access to said pencil holder.

Each support compartment is attached by hinges to a cross-member fixed to the underside of the work surface panel. The support compartments fold under the work surface panel where they are held by respective magnetic catches. Spacing of the support compartment away from the underside of the work surface panel when folded parallel to the work surface panel is accomplished both by the hinge attachment to the cross-members rather than to the work surface panel itself and by the use of conventional offset axis hinges. The space thus provided between the folded storage compartments and the work surface panel accomodates either a drawer or a fixed pocket storage on the underside of the work surface panel.

A drawer is allowed to slide on sides held in channels, each channel being formed by a groove in the underside of the work surface panel aligned with a rabbet cut along one edge of the corresponding cross-member.

When closed, the drawer is held by a spring loaded pin which engages a depression in a strike plate fixed to the underside of the work surface panel. The drawer is allowed to open both toward the user for general access and away from the user where it forms a platform, regardless of its contents, for placing an extra reference book or other items while using the aforementioned work surface panel.

When folded for storage, the desk is freestanding by the fact that the hingeable members extend to the front edge of the work surface panel where they join the frontal upright member of the storage compartment at ninety (90) degrees. The hingeable members extend beyond the user (rear) edge of the work surface panel such that the broad faces of the hingeable members form arm rests. When folded the rear uprights are easily grasped in the manner of handles and, being affixed ninety (90) degrees to the hingeable members, the upright members are parallel to the floor when the desk is folded and freestanding.

When paper or book items are found to slide from the inclined desk surface, these can be retained by raising one or more slotted tabs attached within the drawer to the rear drawer face. For the tabs to be raised the drawer must be opened slightly rearwardly where a second strike plate may also be fitted for a positive drawer stop.

In another embodiment, not hidden within the drawer, these same stop tabs may be mounted on the user edge of the work surface panel itself.

BRIEF DESCRIPTION OF THE DRAWINGS

The embodiments of this invention is elaborated in the description which follows and refers to these accompanying drawings.

DESCRIPTION OF THE DRAWINGS INCLUDING THE PREFERRED EMBODIMENT

Figure 1:
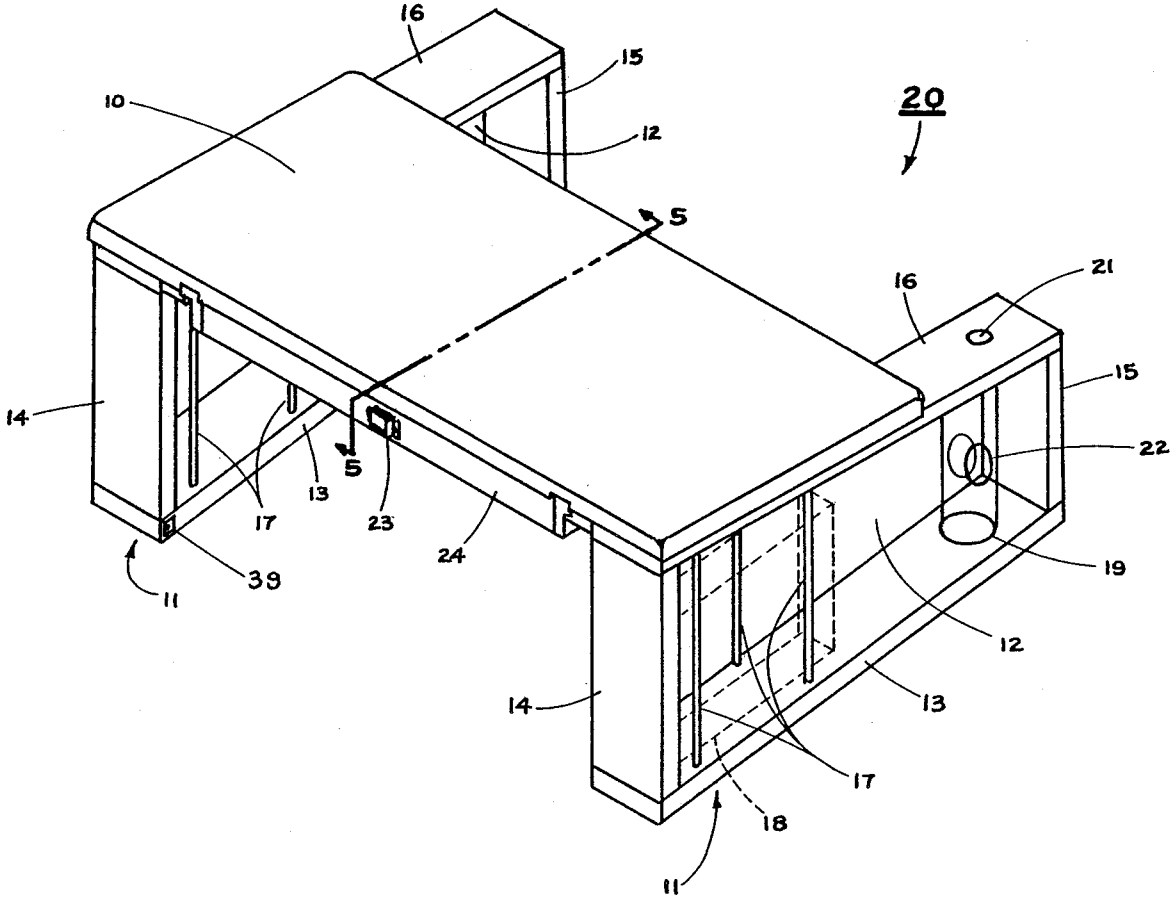
FIG. 1 is a perspective view of the invention showing a book contained in one support compartment with the pencil holder in the same support compartment.

Referring to FIG. 1, work surface panel 10 of the preferred form of portable desk 20 of the invention is sustained on support compartments 11 which are paired and shown extended. Each support compartment 11 forms a quadrangle enclosure 12 consisting of a base member 13, front upright member 14, rear upright member 15, and hingeable member 16. The storage space of each support compartment has a 360 degree enclosure along the quadrangle perimeter of joined members and two generally open sides which are opposed to each other. Barrier side rails 17 allow for the alignment of an object such as book 18 such that it will not fall from enclosure 12 when positioned between the side rails which align the book parallel within the plane of enclosure 12. Hingeable member 16 extends rearwardly of work surface panel 10 and acts as an arm or elbow rest for the user.

Pencil holder 19 which is a tube that is cylindrical in this embodiment and is held between base member 13 and hingeable member 16 to contain pens and pencils which can be accessed through passage hole 21 provided in hingeable member 16 by finger manipulation by using finger openings 22.

Figure 2:
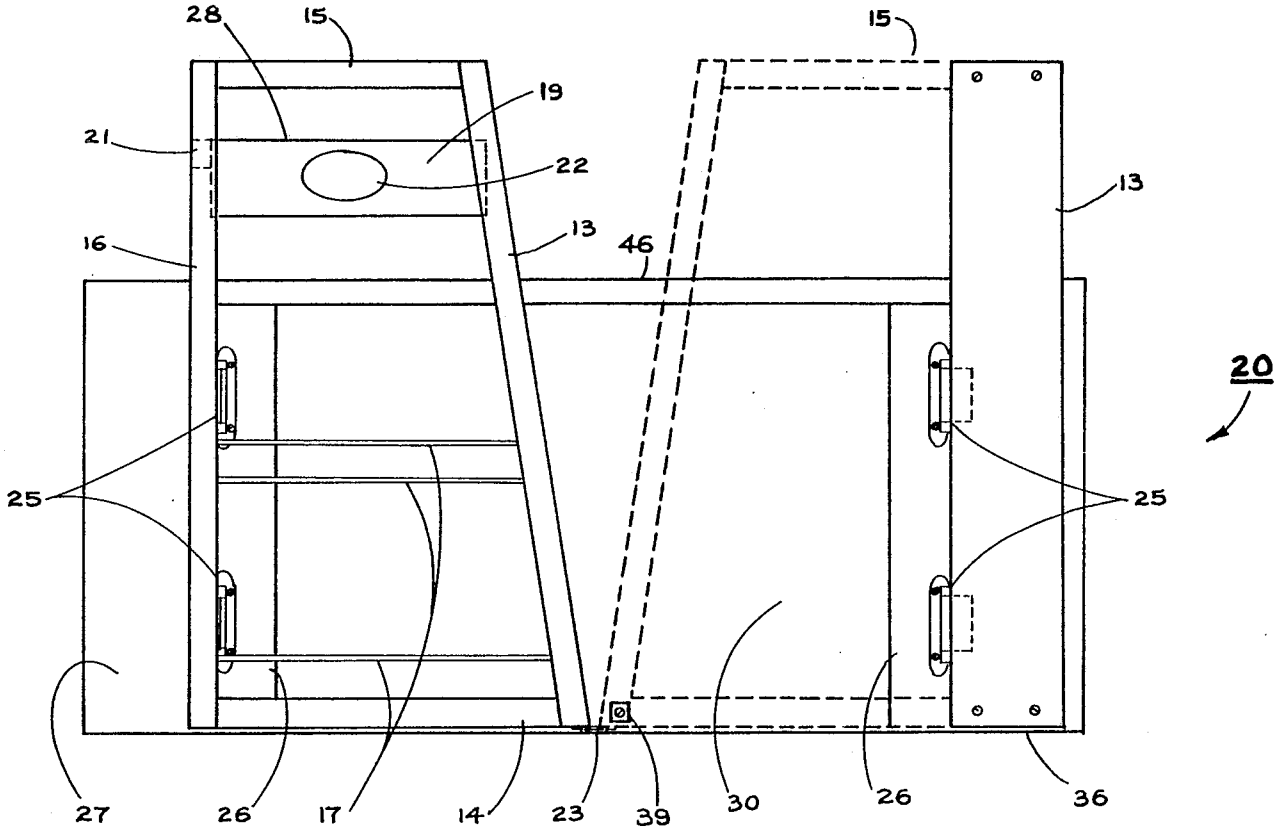
FIG. 2 is an underside view of the invention which depicts the (user's) left support compartment folded as oriented for freestanding storage.

Referring next to FIG. 2, the left side support compartment 11 is shown folded parallel to the work surface panel 10 and is held in place by magnet catch 23 which is fixed on drawer front face 24. Support compartment 11 is hinged by offset hinge 25 to cross-member 26 which in turn is fixed to the underside 27 of work surface panel 10. From this underside view it is noted that front upright member 14 is parallel or flush to front edge 36 of work surface panel 10 allowing for freestanding stability. Support compartment 11 extends well beyond the rear edge 46 of the work surface panel 10 such that rear upright member 15 can be grasped as a handle. Holder 19 continues to retain pencils in the horizontal attitude since passage hole 21 is aligned with upper wall 28 of cylindrical holder 19.

Figure 3:
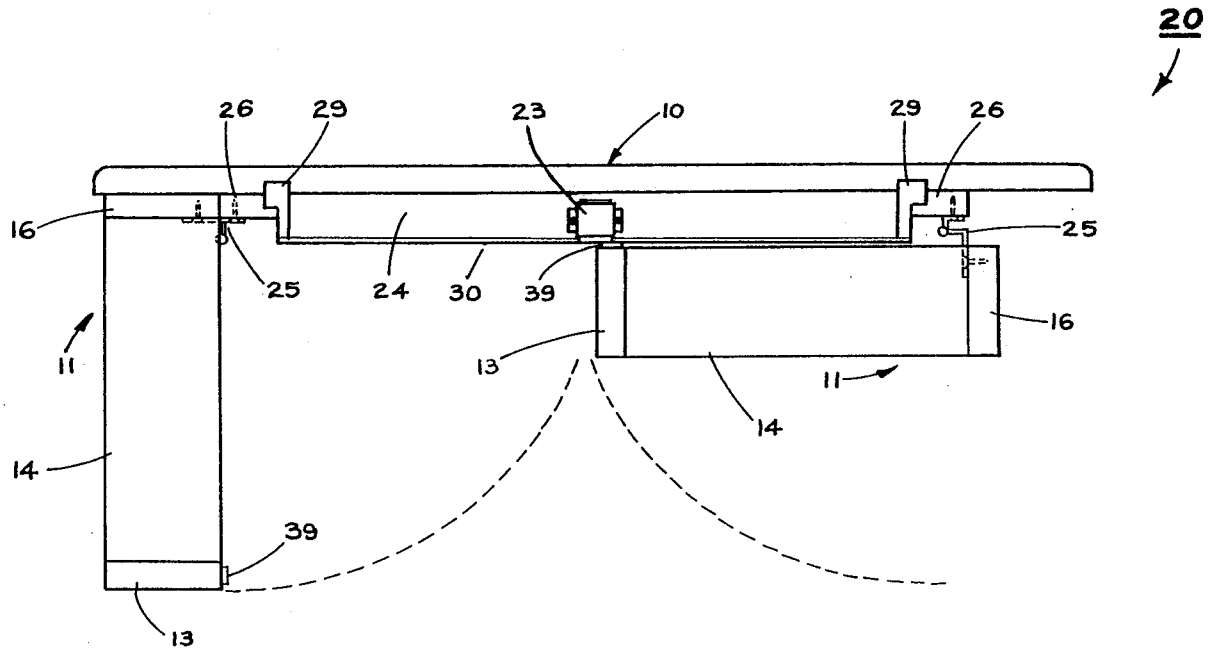
FIG. 3 is a frontal view with the user's left support compartment folded and the right support compartment extended.
Figure 4:
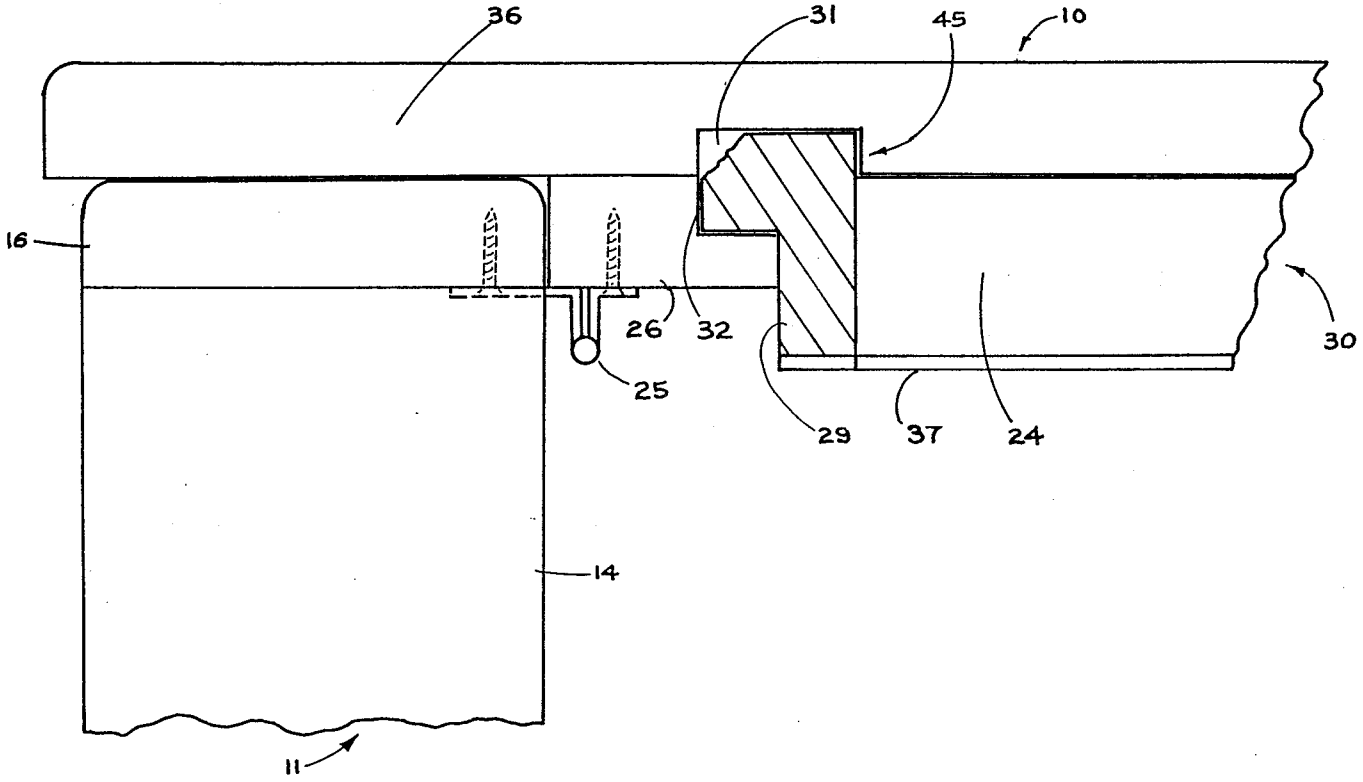
FIG. 4 illustrates an enlarged frontal view of a portion of the work surface panel with the right storage compartment extended.

Referring to FIG. 3 drawer front face 24 is shown with one support compartment 11 hinged by offset axis hinge 25 in a collapsed posture which is spaced from work surface panel 10 by mounting to cross-member 26 such that support compartment 11 is parallel to the work surface panel 10 when held to magnet catch 23 mounted on drawer front face 24. Magnetic catch plates 39 affixed to support compartments 11 are formed from a suitable metallic composition for attraction by catch 23. Drawer side 29 is shown engaged in slide channel 31 which is comprised of groove 45 in underside 27 of work surface panel 10 and rabbet 32 in cross-member 26 as seen in FIG. 4. Drawer 30 will open both toward and away from the user as required.

Figure 5:
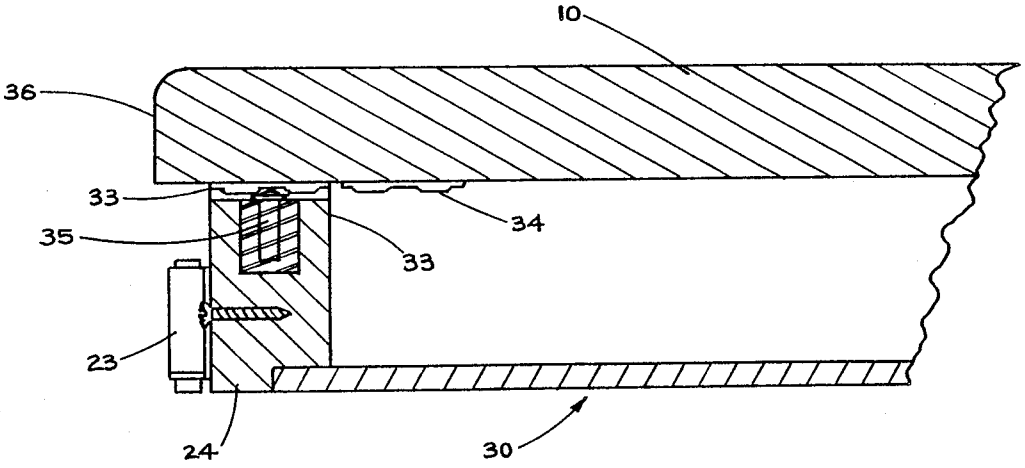
FIG. 5 is a partial cross-sectional view along lines 5—5 of FIG. 1 depicting the spring loaded pin mounted in the drawer frontpiece and its accompanying strike plates.

FIG. 5 shows a middle cross-sectional view through work surface panel 10 along lines 5—5 of FIG. 1 at front strike plate 33 which fixes drawer 30 closed and rear strike plate 34 which fixes drawer 30 slightly rearwardly opened. Spring loaded pin 35 which contacts strike plates 33 and 34 is shown mounted in drawer front face 24.

Figure 6:
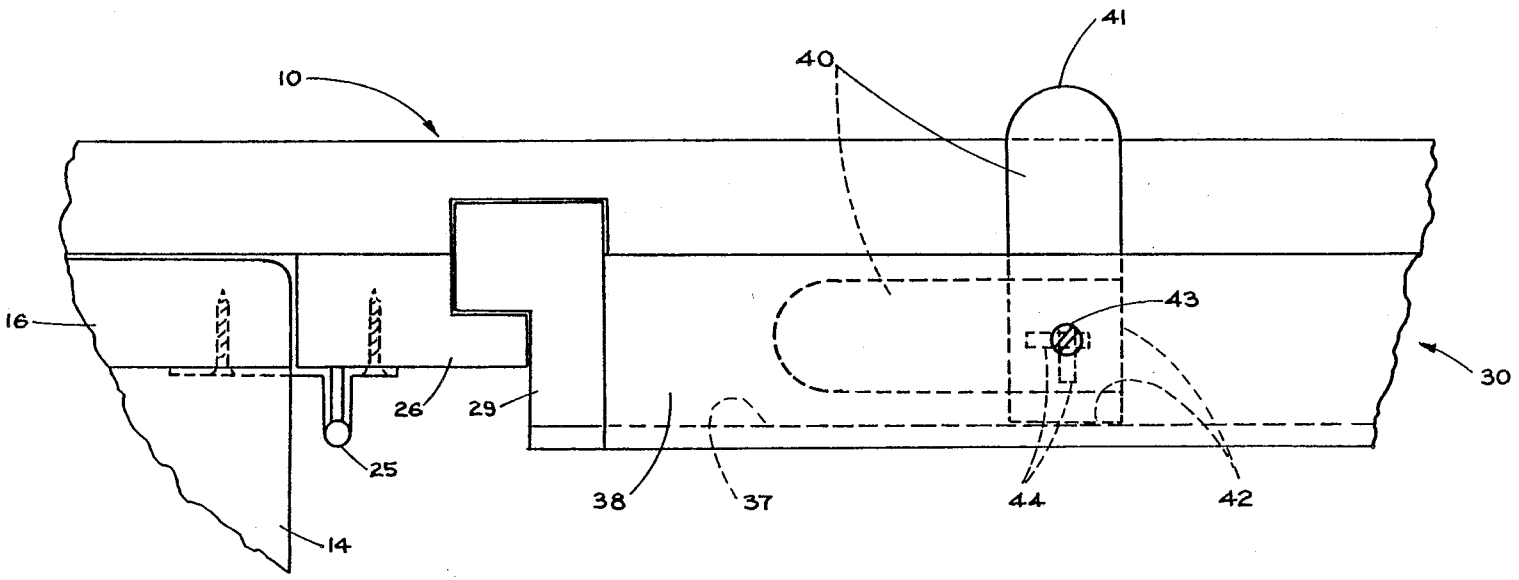
FIG. 6 is a frontal view of a slotted stop tab mounted against the inside of the drawer rear face, and FIG. 7 demonstrates the stop tabs as mounted directly on an inclined work surface panel edge.
Figure 7:
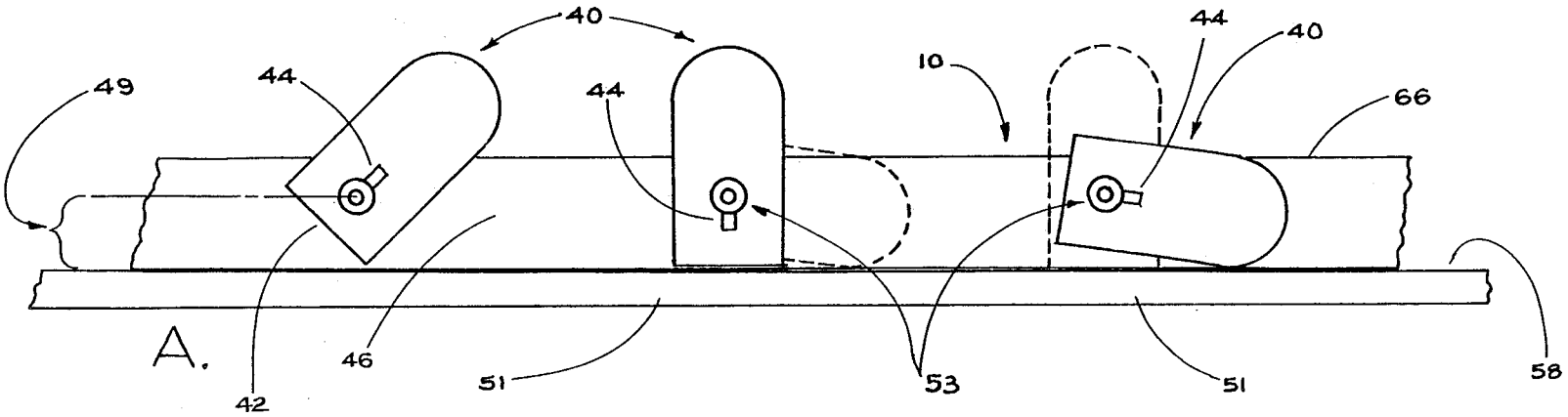
FIG. 7A shows the rear or user edge of the work surface panel with stop tabs both raised and lowered and FIG. 7B a side view of the inclined work surface panel with a single stop tab in a raised position.
Figure 7:
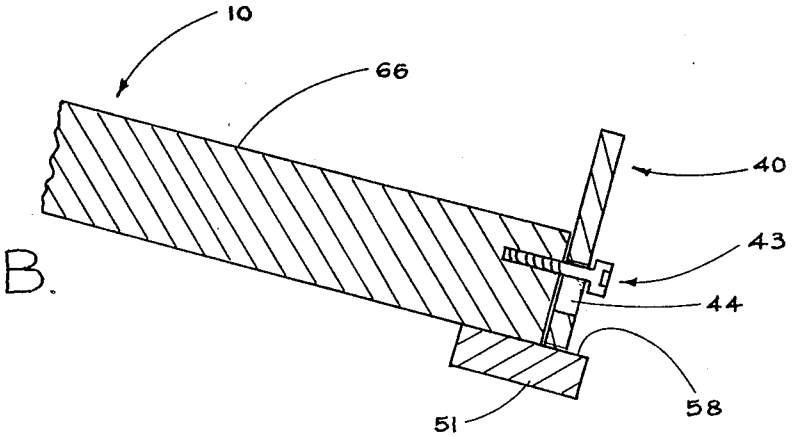

Referring to FIG. 6, a substantially rigid elongated planar slotted stop tab 40 with a rounded upper end 41 and squared lower end 42 is shown mounted to the inside surface of drawer rear face 38 by tab pivot post 43 which is an ordinary screw with a head fixed such that the distance from a corner of tab 40 to the lower (nearest) end of slot 44 is less than the height of tab post 43 from drawer bottom 37. Slotted tab 40 may be laid flat or stood upon its squared lower end 42 by appropriate manual rotation after being pulled to the lower limit of slot 44. The squared lower end 42 is substantially perpendicular to the longitudinal axis of elongated tab 40. Retractable tab 40 may be formed of a thin metal or other suitable material and is used as a stop to prevent paper, books, ect. from sliding off inclined work surface panel 10. Drawer bottom 37 serves as a rest for end 42 and stop tab 40. Drawer bottom 37 serves as a rest for end 42 of stop tab 40, but other locations for stop tab mounting may be elected. Referring to FIG. 7 stop tabs are shown attached directly to the inclined work surface panel 10 which has an upper surface 66. This may be elected if a drawer component is absent. View A of FIG. 7 shows multiple stop tabs 40 in both raised and lowered positions. View B of FIG. 7 shows a side elevation of a single raised tab. Each stop tab is mounted on pivot post 43 on the rear edge 46 of inclined work surface panel 10. Pivot post 43 includes a head 53 which is wider than the slot 44 such that the stop tab 40 is held against the face of rear edge 46.

Bottom projection 51 has a substantially flat surface 58 upon which lower end 42 of elongated stop tab 40 firmly rests. For each functioning tab 40, the post 43 is located at a distance 49 from the flat surface 58 which exceeds the distance from the lower end of slot 44 to a corner of the lower end 42 of the stop tab, such that the tab 40 may be rotated between raised and lowered positions.

From the description of the preferred embodiment of the invention, a variety of functions are addressed by components which could be modified in location, shape, and anchor points for esthetic reasons or to change or delete selected functional purposes without such modification being a departure from the scope of the invention and appended claims.

I claim:

1. A portable desk comprising: a planar work surface panel, a pair of support compartments attached to said work surface panel, said compartment comprising a multiplanar perimeter defining a storage space within the plane of enclosure of said perimeter and two opposed sides which define access openings to said storage space, said sides provided with a plurality of partially retaining barriers joined to said perimeter, said barriers positioned such that a generally planar object, such as a book, may be aligned within said perimeter enclosure.

2. A portable desk as claimed in claim 1 providing an arm rest when said work surface panel is in use and supported upon said support compartments and providing a graspable handle when said desk is placed in storage, standing upon the front edge of said work surface panel comprising:

an extension of said multiplanar perimeter of said support compartment beyond said work surface panel.

3. A portable desk as claimed in claim 1 wherein each of said support compartments is hingedly mounted to said work surface panel and foldable between:

an extended position for use of the desk wherein the plane of enclosure of said multiplanar perimeter is substantially perpendicular to said work surface panel and a folded configuration wherein said plane of enclosure is substantially parallel to said work surface panel.

4. A portable desk as claimed in claim 3 and including a cross-member, said cross-member attached to the underside of said work surface panel, said compartment hingedly connected to said cross-member whereby the axis of rotational folding of said compartment is spaced from the underside of said work surface panel.

5. A portable desk as claimed in claim 4 including a drawer moveably affixed beneath said work surface panel, said drawer providing a catch means to maintain said support compartment in the folded configuration.

6. A portable desk as claimed in claim 3 allowing said desk to be freestanding upon the front edge of said work surface panel when said support compartment is in a folded configuration for storage, wherein a portion of said perimeter of said support compartment is flushly aligned with the front edge of said work surface panel when folded thereunder.

7. A portable desk as claimed in claim 6 wherein said perimeter of said support compartment comprises a base, a front upright member, a rear upright member, a hingeable member, said front upright and said rear upright members affixed at a ninety degree angle to said hingeable member.

8. A portable desk as claimed in claim 7 wherein said work surface panel is inclined according to the angle of intersect of said base member with said front and rear upright members.

9. A portable desk comprising a planar work surface and at least one support including an improved pencil holder able to retain pencils in a variety of positional orientations of said desk during storage, movement, and usage comprising: a tubular member, a first end of said member which is fully closed, a second end which is partially sealed by a cover, said cover defining a single opening sufficiently large for the passage of a pencil aligned within side walls of said tubular members, said side walls providing at least one aperture sufficiently large for one or more fingers of the user to enter in order to manipulate a pencil through said opening at said second end, said pencil holder attachable along at least one of its surfaces to said desk.

10. A portable desk comprising: a work surface panel, a pair of support compartments, each of said compartments having a plurality of perimeter members defining an enclosure with two opposed sides generally open through a plurality of partial barriers joined to the outer edges of said perimeter members, said compartments hingedly mounted to the underside of said work surface panel at opposite ends thereof, said support compartments foldable from an extended position which is perpendicular to said work surface panel to a position parallel with and beneath said work surface panel, a drawer, said drawer being slideable relative to said work surface panel whereby said drawer is sandwiched between said work surface panel and said support compartments when said support compartments are folded in a parallel position with said work surface panel and where by the axis of rotation of said support compartment is spaced from the underside of said work surface panel.

11. A retractable and rotatable stop tab combination attached to an edge of an inclined work surface such as a desk top to prevent books or the like from sliding off the inclined surface, comprising:

an elongated member, having a lower end which is substantially squared in relation to the long axis, said lower end also having a slot, a post positioned within said slot, a first surface provided substantially perpendicular to the plane of said inclined surface and attached thereto and a second surface provided substantially parallel to said inclined surface and intersecting said first surface, said post fixed to said first surface at a distance from said intersection of said first and second surfaces which is greater than the distance from a corner of said squared lower end to said slot, whereby said elongated member may stand on its squared lower end upon said second surface and can be rotated around said post from a retracted position to an upright position which projects above said inclined work surface to thereby prevent a book from sliding off the inclined surface.

12. A retractable stop tab as claimed in claim 11 wherein said first surface is provided by the inner aspect of a drawer, said drawer slideably mounted beneath said work surface, said stop tab rotating upon said post mounted on said inner aspect and said second surface provided by the intersecting bottom of said drawer, whereby said stop tab may be retractably stored within the closed drawer or rotated from the partially opened drawer to project above the inclined work surface.

13. A retractable stop tab as claimed in claim 11 wherein said first surface for the mounting of said post is provided by the lower edge of the panel of said inclined work surface, which is a plane substantially perpendicular to said work surface, and said second surface is provided by a shelf-like projection intersecting said lower edge, such that said stop tab is held against said lower edge and can be retracted below or projected above said inclined work surface.

* * * * *